US011998111B2

(12) United States Patent
Choi

(10) Patent No.: US 11,998,111 B2
(45) Date of Patent: Jun. 4, 2024

(54) FRAME WITH OUTWARDLY SLANTED LEGS AND TABLE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/589,174

(22) Filed: Jan. 31, 2022

(65) Prior Publication Data

US 2022/0240665 A1 Aug. 4, 2022

(30) Foreign Application Priority Data

Feb. 4, 2021 (CN) ..... 202120313878.6

(51) Int. Cl.
*A47B 3/00* (2006.01)
*A47B 3/091* (2006.01)
*A47B 3/10* (2006.01)

(52) U.S. Cl.
CPC ..... *A47B 3/0912* (2013.01); *A47B 3/0916* (2013.01); *A47B 3/10* (2013.01)

(58) Field of Classification Search
CPC ..... A47B 3/0912; A47B 3/0916; A47B 3/10; A47B 3/087; A47B 3/0913; A47B 3/083; A47B 13/003; A47B 2003/008
USPC ..... 108/34, 130–133, 167, 36; 248/439, 248/188.1, 188.6
See application file for complete search history.

(56) References Cited

U.S. PATENT DOCUMENTS 348,733 A * 9/1886 Geseen et al.
1,063,642 A 6/1913 Birdsell
1,155,971 A * 10/1915 Thornton ..... A47B 3/04 108/34
2,136,569 A 11/1938 Trimpi
2,622,353 A * 12/1952 Mendelson ..... D06F 81/04 38/139
2,803,033 A 8/1957 Rachman
2,803,050 A 8/1957 Fernberg
2,868,599 A 1/1959 Roggio
3,075,809 A 1/1963 Wilson
3,187,373 A 6/1965 Fisher
3,368,504 A 2/1968 Cohen
3,410,232 A 11/1968 Bills
3,410,327 A 11/1968 Ausnit
(Continued)

FOREIGN PATENT DOCUMENTS

CA 2971886 A1 12/2018
CN 216123992 * 3/2022
(Continued)

*Primary Examiner* — Janet M Wilkens
(74) *Attorney, Agent, or Firm* — MORGAN, LEWIS & BOCKIUS LLP

(57) ABSTRACT

A foldable frame with enhanced stability includes a mounting assembly, a first leg assembly and a second leg assembly. Each of the first and second leg assemblies are pivotally coupled with the mounting assembly and rotatable with respect to the mounting assembly between a use position and a storage position. Each of the first and second leg assemblies includes a substantially straight first leg and a substantially straight second leg. The first and second legs are slanted outwardly to increase the supporting area and thus enhance the stability of the foldable frame and stability of other structures supported by the foldable frame.

17 Claims, 7 Drawing Sheets

(56) References Cited

U.S. PATENT DOCUMENTS 3,416,468 A * 12/1968 Peterson ..... A47B 3/0916 108/131
3,861,328 A 1/1975 Lawless
4,111,482 A 9/1978 Jones
4,191,111 A 3/1980 Emmert
4,285,105 A 8/1981 Kirkpatrick
4,561,108 A 12/1985 Kamp
4,792,240 A 12/1988 Ausnit
5,325,794 A 7/1994 Hontani
5,392,718 A 2/1995 Stevens
5,483,710 A 1/1996 Chan
5,676,062 A 10/1997 Lloyd
5,745,954 A 5/1998 Shogan
5,857,229 A 1/1999 Magnani, Jr.
5,921,623 A 7/1999 Nye
6,173,660 B1 * 1/2001 Emmert ..... B25H 1/06 108/90
6,223,366 B1 5/2001 Cheng
6,347,831 B1 2/2002 Nye
6,363,550 B1 4/2002 Wang
6,508,262 B1 1/2003 Takayama
6,530,331 B2 3/2003 Stanford
6,644,734 B1 11/2003 Tseng
6,843,183 B2 1/2005 Strong
6,928,934 B2 * 8/2005 Zheng ..... A47B 3/0911 108/127
6,971,321 B1 12/2005 Strong
7,055,563 B2 * 6/2006 Logan ..... B25H 1/04 144/287
7,059,254 B2 6/2006 Strong et al.
7,096,799 B2 8/2006 Strong et al.
7,097,380 B2 8/2006 Lee
7,171,910 B2 2/2007 Neunzert et al.
7,260,871 B2 8/2007 Borchardt
7,428,872 B2 9/2008 Strong et al.
7,475,643 B2 1/2009 Haney et al.
7,475,644 B2 1/2009 Strong et al.
7,634,969 B2 12/2009 Neunzert et al.
7,640,870 B2 1/2010 Strong et al.
7,644,667 B2 1/2010 Strong et al.
7,735,431 B2 6/2010 Neunzert et al.
7,874,303 B2 1/2011 Xie
8,006,630 B2 8/2011 Strong et al.
8,033,228 B2 10/2011 Haney et al.
8,042,475 B2 10/2011 Larcom et al.
8,113,130 B2 2/2012 Leng
8,132,517 B2 * 3/2012 Leng ..... A47C 4/22 248/439
8,156,875 B2 4/2012 Neunzert et al.
8,302,541 B2 11/2012 Haney et al.
8,342,107 B2 1/2013 Mover et al.
8,424,471 B2 * 4/2013 Zhu ..... A47B 3/0913 108/132
8,534,205 B1 9/2013 Johnson et al.
8,578,865 B2 11/2013 Haney et al.
8,622,007 B2 1/2014 Peery et al.
8,746,155 B2 6/2014 Haney et al.
8,757,069 B2 6/2014 Peery et al.
8,904,943 B2 12/2014 Jin
9,027,952 B2 5/2015 Zhu
9,103,368 B2 8/2015 Mendes
D748,418 S 2/2016 Johnson et al.
9,277,808 B2 3/2016 Cai et al.
9,282,812 B2 3/2016 Chang
D756,694 S 5/2016 Johnson et al.
9,351,563 B2 5/2016 Bennett et al.
9,462,880 B1 10/2016 Lin
10,159,334 B1 12/2018 Wang
10,470,561 B2 11/2019 Clegg et al.
11,234,525 B1 2/2022 Tsai
11,382,416 B2 * 7/2022 Choi ..... A47B 3/14
11,578,832 B2 * 2/2023 Choi ..... A47C 19/122
2003/0089286 A1 5/2003 Wang
2003/0196574 A1 * 10/2003 Sagol ..... B29C 45/44 108/115
2004/0031422 A1 * 2/2004 Wong ..... A47B 3/087 108/132
2004/0070235 A1 4/2004 Gregory
2004/0195869 A1 10/2004 Zhurong
2005/0005826 A1 1/2005 Strong
2005/0097829 A1 5/2005 Seo
2005/0103239 A1 5/2005 Neunzert
2005/0241550 A1 11/2005 Neunzert
2005/0279260 A1 12/2005 Stanford
2006/0062632 A1 3/2006 Jang
2006/0181114 A1 8/2006 Nye
2006/0196395 A1 9/2006 Lin
2007/0079441 A1 4/2007 Chen
2008/0078310 A1 4/2008 VanNimwegen
2013/0000528 A1 1/2013 Jin
2013/0025509 A1 1/2013 Jin
2013/0233210 A1 9/2013 Jin
2014/0030012 A1 1/2014 Lee
2014/0070070 A1 3/2014 Shinoda
2014/0099155 A1 4/2014 Chen
2014/0130837 A1 5/2014 Sy-Facunda
2016/0348395 A1 12/2016 Jin
2017/0013955 A1 1/2017 Lin
2017/0238698 A1 * 8/2017 Nye ..... E04C 2/326
2017/0325592 A1 11/2017 Suh
2017/0340100 A1 11/2017 Tsai
2018/0153302 A1 6/2018 Jiang
2018/0171648 A1 6/2018 Woodward
2019/0150608 A1 5/2019 Johnson et al.
2019/0284831 A1 9/2019 Volin
2019/0292808 A1 9/2019 Dotterweich
2020/0029684 A1 1/2020 Jiang
2020/0390233 A1 12/2020 Leng
2021/0112968 A1 4/2021 Ponomar
2021/0177135 A1 6/2021 Leng
2021/0274929 A1 9/2021 Choi
2021/0274930 A1 9/2021 Choi
2022/0022643 A1 1/2022 Choi
2022/0330691 A1 * 10/2022 Choi ..... A47B 13/003

FOREIGN PATENT DOCUMENTS

DE 29515948 U1 1/1996
EP 1492432 B1 10/2016
WO WO 2013000149 A1 1/2013

* cited by examiner

FRAME WITH OUTWARDLY SLANTED LEGS AND TABLE HAVING SAME

CROSS-REFERENCE TO RELATED APPLICATIONS

The present application claims priority to Chinese Utility Model Application CN 202120313878.6 filed Feb. 4, 2021. The disclosure of the application is incorporated herein for all purposes by reference in its entirety.

FIELD OF THE INVENTION

The present invention generally relates to frames and tables. In particular, the present invention relates to foldable frames and tables with outwardly slanted legs to enhance the stability of the frames and tables.

BACKGROUND

Foldable tables are more and more popular these days. A typical foldable table usually includes a tabletop and a supporting frame to support the tabletop. However, many existing foldable tables are configured with vertical legs. As a result, existing foldable tables are often less stable. In addition, some existing foldable tables are difficult to fold and unfold, and thus inconvenient to use.

Given the current state of the art, there remains a need for supporting frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides supporting frames and foldable tables with structures to expand supporting areas and enhance the stability.

In various exemplary embodiments, the present disclosure provides a frame including a mounting assembly, a first leg assembly and a second leg assembly. Each of the first and second leg assemblies is pivotally coupled with the mounting assembly and rotatable with respect to the mounting assembly between a use position and a storage position. Each of the first and second leg assemblies includes a first leg and a second leg. At least a majority portion of each of the first and second legs is substantially straight. Also, the first and second legs of the first or second leg assembly are slanted outwardly relative to each other at a first angle. Further, when in the use position, the first legs of the first and second leg assemblies or the second legs of the first and second leg assemblies are slanted outwardly relative to each other at a second angle. In addition, when in the storage position, the first and second assemblies are folded toward the mounting assembly.

In some exemplary embodiments, the first angle is between about 6° and about 26°. The second angle is between about 4° and about 20°.

In some exemplary embodiments, the first angle is different than the second angle.

In some exemplary embodiments, the first and second legs of the first or second leg assembly are symmetric with respect to each other.

In some exemplary embodiments, the first and second leg assemblies are symmetric with respect to each other.

In some exemplary embodiments, each of the first and second leg assemblies further includes a lateral leg bar connecting the first and second legs of the first or second leg assembly.

In some exemplary embodiments, the frame further includes first and second supporting assemblies to control rotation of the first and second leg assemblies with respect to the mounting assembly or help stabilize the first and second leg assemblies when they are in the use position. Each of the first and second supporting assemblies includes a first supporting member, a slider, and one or more second supporting members. The first supporting member has an end pivotally coupled with the first or second leg assembly. The slider is coupled with the first supporting member and selectively movable along the first supporting member. Each of the one or more second supporting members has an end pivotally coupled with the slider and another end pivotally coupled with the mounting assembly.

In some exemplary embodiments, the mounting assembly includes a first longitudinal mounting member and a second longitudinal mounting member spaced apart from each other. The mounting assembly also includes a first lateral mounting member and a second lateral mounting member spaced apart from each other and coupled with the first and second longitudinal mounting members. The mounting assembly further includes a plurality of couplers disposed at the first and second lateral mounting members and configured to pivotally couple the first and second legs of the first and second leg assemblies.

In an exemplary embodiment, the plurality of couplers is disposed at an interior side of the mounting assembly.

In some exemplary embodiments, each of the first and second longitudinal mounting members includes a first bar segment and a second bar segment pivotally coupled with each other.

In various exemplary embodiments, the present disclosure provides a frame including a mounting assembly. The mounting assembly includes a first lateral mounting member, a second lateral mounting member and a third lateral mounting member spaced apart in a first direction, with the third lateral mounting member disposed between the first and second lateral mounting members. The frame also includes first and second leg assemblies, each pivotally coupled with the mounting assembly and rotatable with respect to the mounting assembly between a use position and a storage position. Each of the first and second leg assemblies include a substantially straight first leg, a substantially straight second leg and a lateral leg bar. The substantially straight first leg has an upper end portion pivotally coupled with the first or second mounting member at a first position. The substantially straight second leg has an upper end portion pivotally coupled with the first or second mounting member at a second position. The lateral leg bar is coupled with the first leg and the second leg. The lateral leg bar has a length greater than a distance between the first and second positions such that the first and second legs of the first or second leg assembly are slanted outwardly relative to each other at a first angle. The frame further includes first and second supporting assemblies, with the first supporting assembly pivotally coupled with the third lateral mounting member of the mounting assembly and first leg assembly and the second supporting assembly pivotally coupled with the third lateral mounting member of the mounting assembly and second leg assembly. The first supporting assembly has a length greater than a distance between the first and third lateral mounting members and the second supporting assembly has a length greater than a distance between the second and third lateral mounting members such that when in the use position, the first legs of the first and second leg assemblies or the second legs of the first and second leg assemblies are slanted outwardly relative to each other at a second angle.

In some exemplary embodiments, the first angle is between about 6° and about 26°, and the second angle is between about 4° and about 20°.

In an exemplary embodiment, the first angle is about 16° and the second angle is about 12°.

In some exemplary embodiments, each of the first and second supporting assemblies includes a first supporting member, a slider, and one or more second supporting members. The first supporting member has an end pivotally coupled with the first or second leg assembly. The slider is coupled with the first supporting member and selectively movable along the first supporting member. Each of the one or more second supporting members has an end pivotally coupled with the slider and another end pivotally coupled with the mounting assembly.

In various exemplary embodiments, the present disclosure provides a table including a table panel coupled with a frame disclosed herein. The frame supports the table panel when in use.

In some exemplary embodiments, the table panel including a first panel and a second panel. The mounting assembly including a first longitudinal mounting member and a second longitudinal mounting. Each of the first and second longitudinal mounting members includes a first bar segment and a second bar segment pivotally coupled with each other. The first panel is coupled with the first bar segments of the first and second longitudinal mounting members. The second panel is coupled with the second bar segments of the first and second longitudinal mounting members.

In some exemplary embodiments, the table panel includes a first groove and a second groove at a lower side of the table panel to accommodate the first and second supporting assemblies when the first and second leg assemblies are in the storage position (e.g., when folded).

The frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
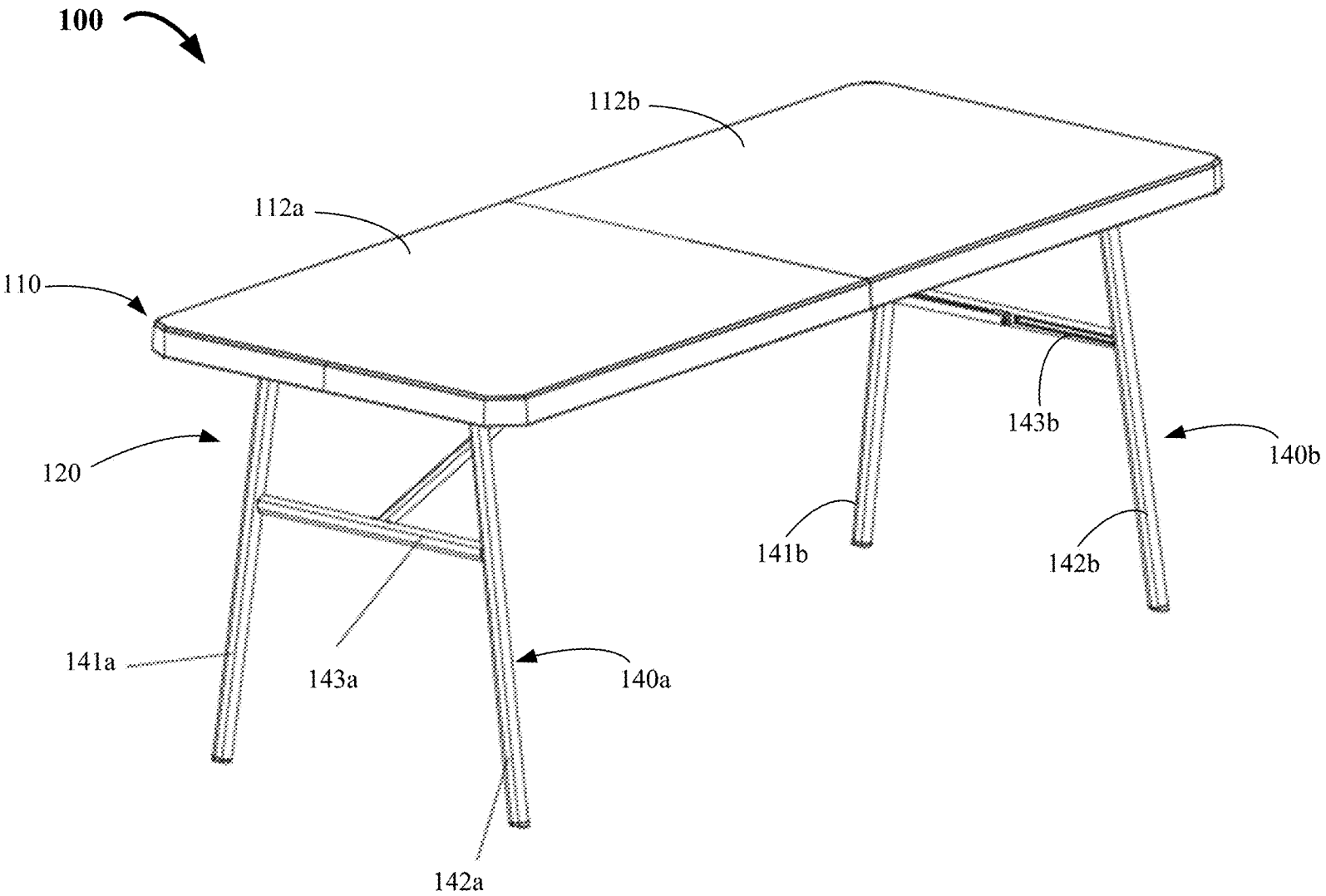
FIG. 1 is a top perspective view illustrating an exemplary foldable table in an unfolded state in accordance with exemplary embodiments of the present disclosure.
Figure 2:
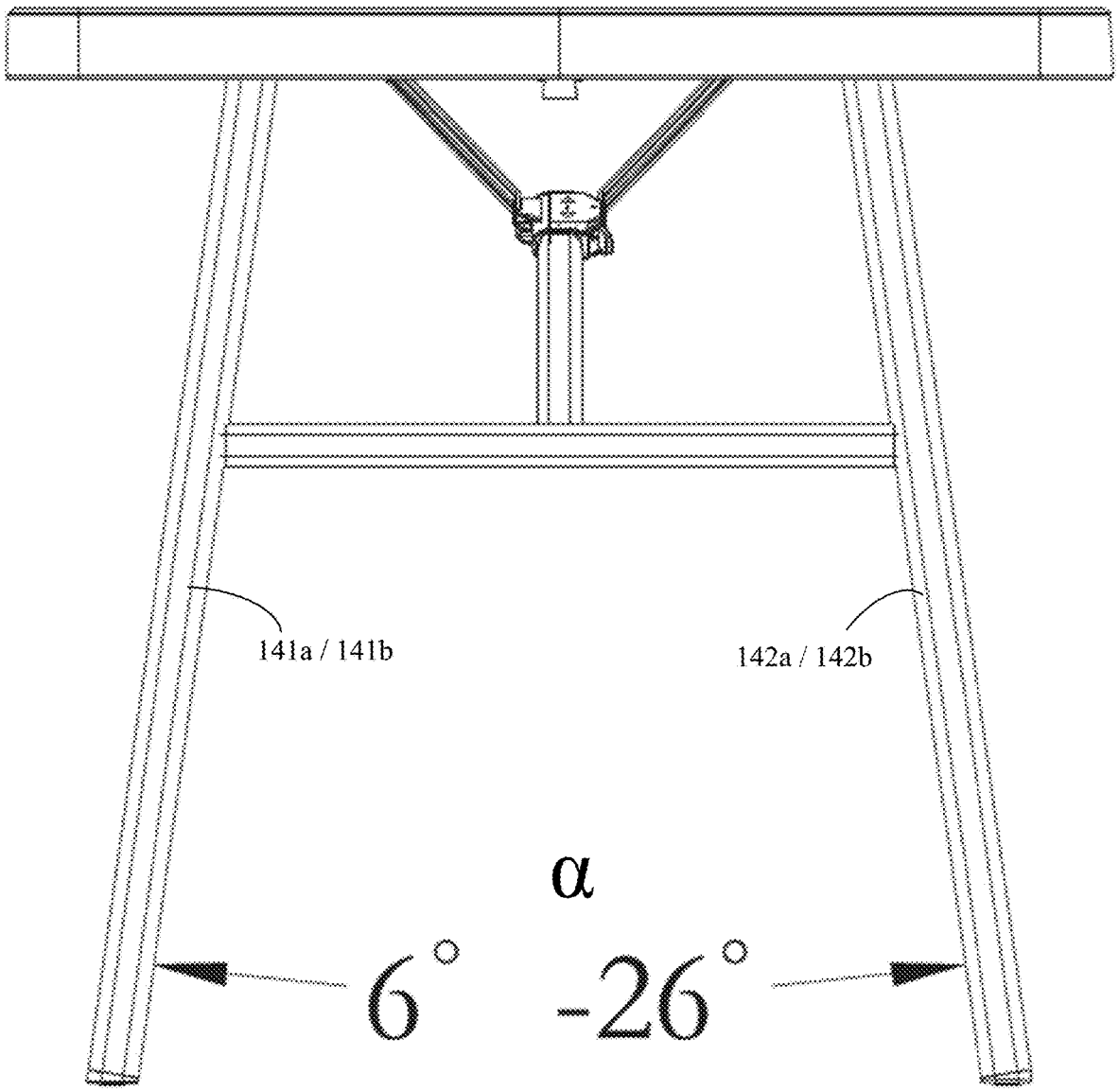
FIG. 2 is a side view illustrating the foldable table of FIG. 1 in accordance with exemplary embodiments of the present disclosure.
Figure 3:
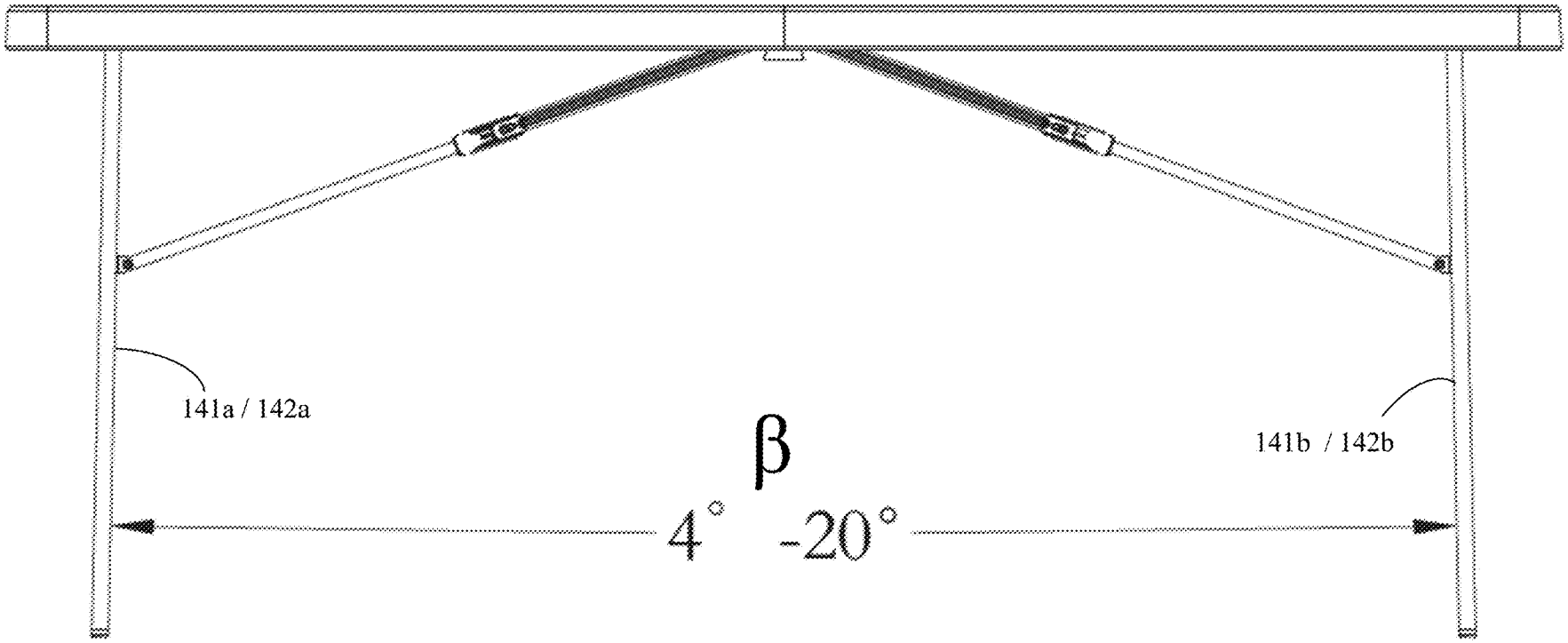
FIG. 3 is another side view illustrating the foldable table of FIG. 1 in accordance with exemplary embodiments of the present disclosure.
Figure 4:
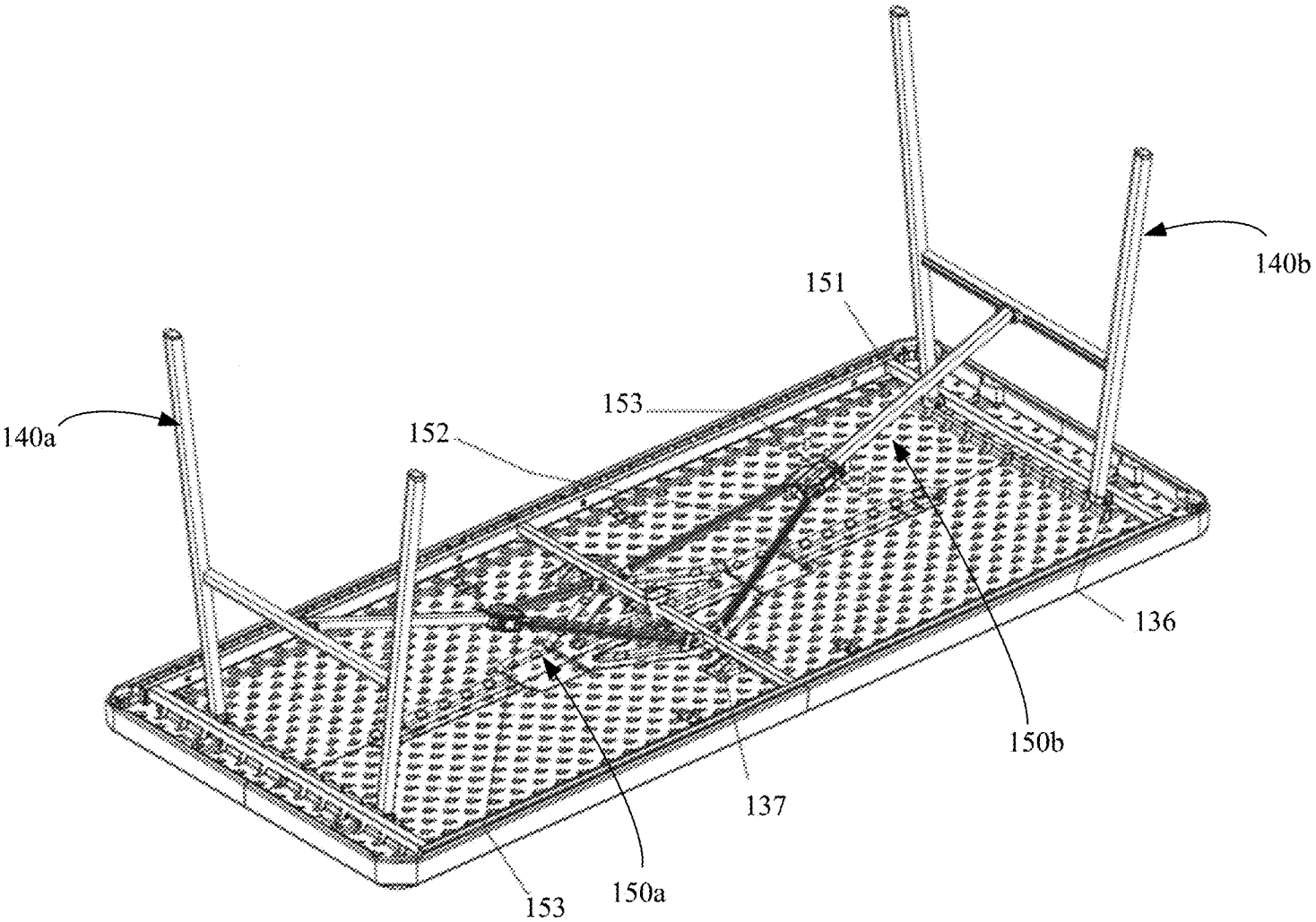
FIG. 4 is a bottom perspective view illustrating the foldable table of FIG. 1 in accordance with exemplary embodiments of the present disclosure.
Figure 5A:
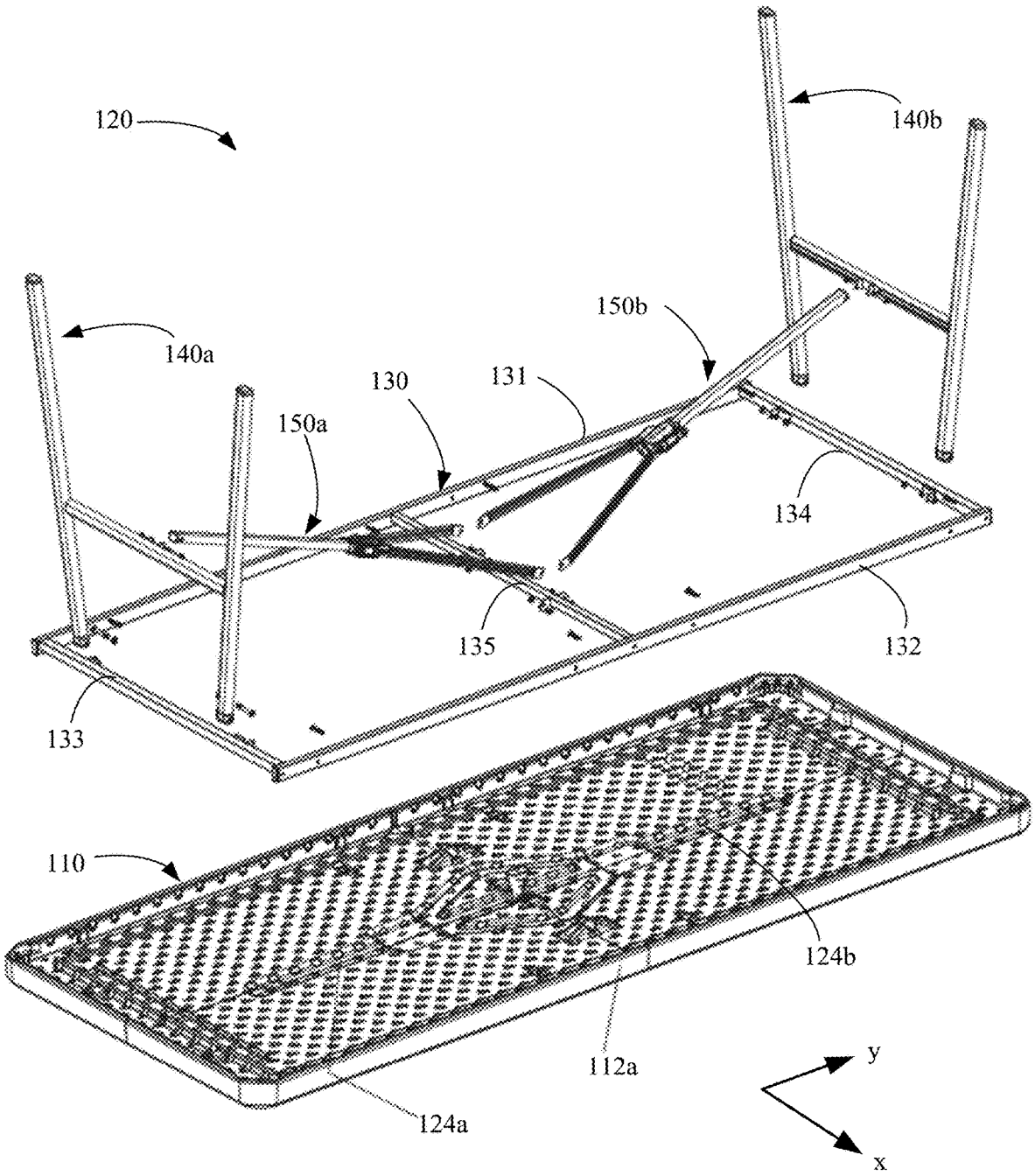
FIG. 5A is a partially dissembled view illustrating the foldable table of FIG. 1 in accordance with exemplary embodiments of the present disclosure.
Figure 5B:
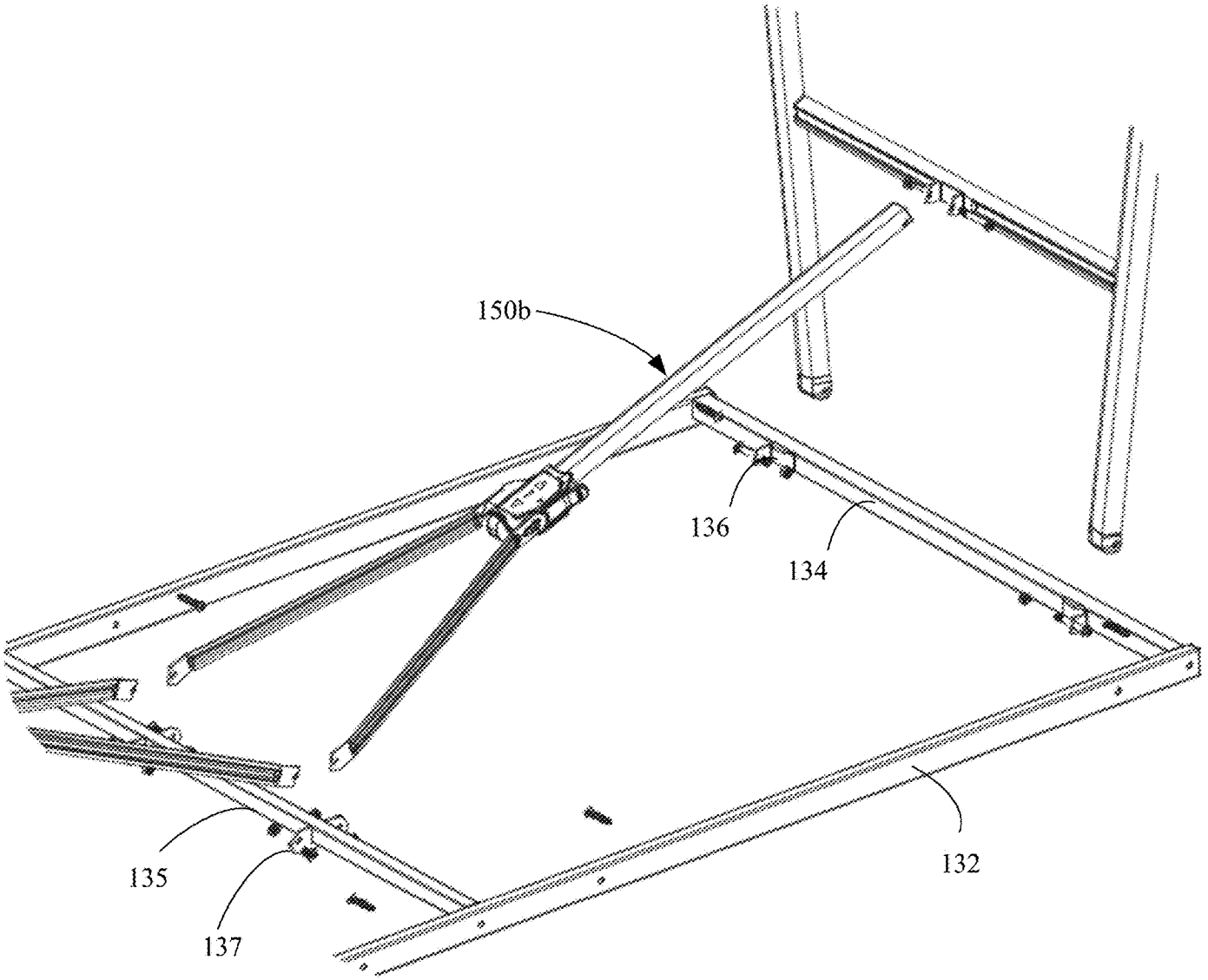
FIG. 5B is a partially enlarged view of FIG. 5A.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable frames and foldable tables supported by foldable frames. A foldable frame generally includes a mounting assembly, a first leg assembly and a second leg assembly. Each of the first and second leg assemblies are pivotally coupled with the mounting assembly and rotatable with respect to the mounting assembly between a use position and a storage position. Each of the first and second leg assemblies includes a substantially straight first leg and a substantially straight second leg. The first and second legs are slanted outwardly to expand the supporting area and thus enhance the stability of the foldable frame and stability of other structures (e.g., table panel) supported by the foldable frame.

As herein, a substantially straight first or second leg refers to a leg with at least a majority portion being substantially straight. For instance, in some embodiments, at least 60%, at least 70%, at least 80%, at least 90%, at least 95% or the entire of the leg is substantially straight along a length direction of the leg.

In some exemplary embodiments, a foldable frame also includes first and second supporting assemblies. The first supporting assembly is pivotally coupled with the mounting assembly and the first leg assembly to control rotation of the first leg assembly with respect to the mounting assembly. Similarly, the second supporting assembly is pivotally coupled with the mounting assembly and the second leg assembly to control rotation of the second leg assembly with respect to the mounting assembly. In some exemplary embodiments, the first and second supporting assemblies help stabilize the first and second leg assemblies when they are in the use position, and/or help support the mounting assembly and other structures (e.g., table panel) coupled with the mounting assembly.

In some exemplary embodiments, the mounting assembly of the foldable frame includes first and second longitudinal mounting members. Each of the first and second longitudinal mounting members includes a first bar segment and a second bar segment pivotally coupled with each other, facilitating folding of the foldable frame in half.

The foldable frame disclosed herein can be used to support a panel or the like. For instance, in some embodiments, the foldable frame is used to support a table panel, thereby providing a foldable table for use. In some embodiments, the table panel includes first and second panels. The first panel is coupled with the first bar segments of the first and second longitudinal mounting members, and the second panel is coupled with the second bar segments of the first and second longitudinal mounting members, thereby producing a table able to be folded in half.

Referring now to FIGS. 1-6, there is depicted exemplary foldable table 100 in accordance with some exemplary embodiments of the present disclosure. As shown, foldable table 100 includes a table panel such as table panel 110 and a frame such as frame 120 coupled with the table panel and supports the table panel when in use. Table panel 110 can be a single unitary panel, or comprised of two or more individual panels. By way of example, FIG. 1 illustrated two panels, e.g., first panel 112*a* and second panel 112*b*. The first and second panels can be, but do not have to be, identical or symmetric to each other. In an embodiment, the first and second panels are substantially the same and substantially symmetrical to each other.

The table panel can be of various shapes including but not limited to a square shape, a round shape or a rectangular shape. It can be made of various materials including but not limited to metals, plastics and woods. In some exemplary embodiments, the table panel or panels are made of plastics by injection molding, blow molding or any other suitable processes.

Frame 120 includes a mounting assembly such as mounting assembly 130. In some exemplary embodiments, mounting assembly 130 includes a plurality of mounting members connected to each other, e.g., either at adjacent end portions or any other suitable portions thereof. For instance, in some embodiments, mounting assembly 130 include first longitudinal mounting member 131, second longitudinal mounting member 132, first lateral mounting member 133 and second lateral mounting member 134 that are connected to each other. In some embodiments, the first and second longitudinal mounting members are spaced apart from each other, for instance, in a first direction (e.g., x-direction in FIG. 5A); and the first and second lateral mounting members are spaced apart from each other, for instance, in a second direction (e.g., y-direction in FIG. 5A). In an embodiment, the first and second directions are substantially perpendicular to each other.

In some exemplary embodiments, the mounting assembly includes additional, optional or alternative elements. For instance, as a non-limiting example, in some embodiments, the mounting assembly further includes a third lateral mounting member such as third lateral mounting member 135 disposed between the first and second lateral mounting members and connected to the first and second longitudinal mounting members. As another non-limiting example, in some embodiments, each of the first and second longitudinal mounting members is made of two or more pivotally connected bar segments. For instance, each of first longitudinal mounting member 131 and second longitudinal mounting member 132 is comprised of first and second bar segments pivotally coupled with each other. In some exemplary embodiments, first bar segments of the first and second longitudinal mounting members are coupled with table panel 112*a* and second bar segments of the first and second longitudinal mounting members are coupled with table panel 112*b*. This results in a table able to be folded in half, which requires less space for storage and is easy to carry.

Figure 6:
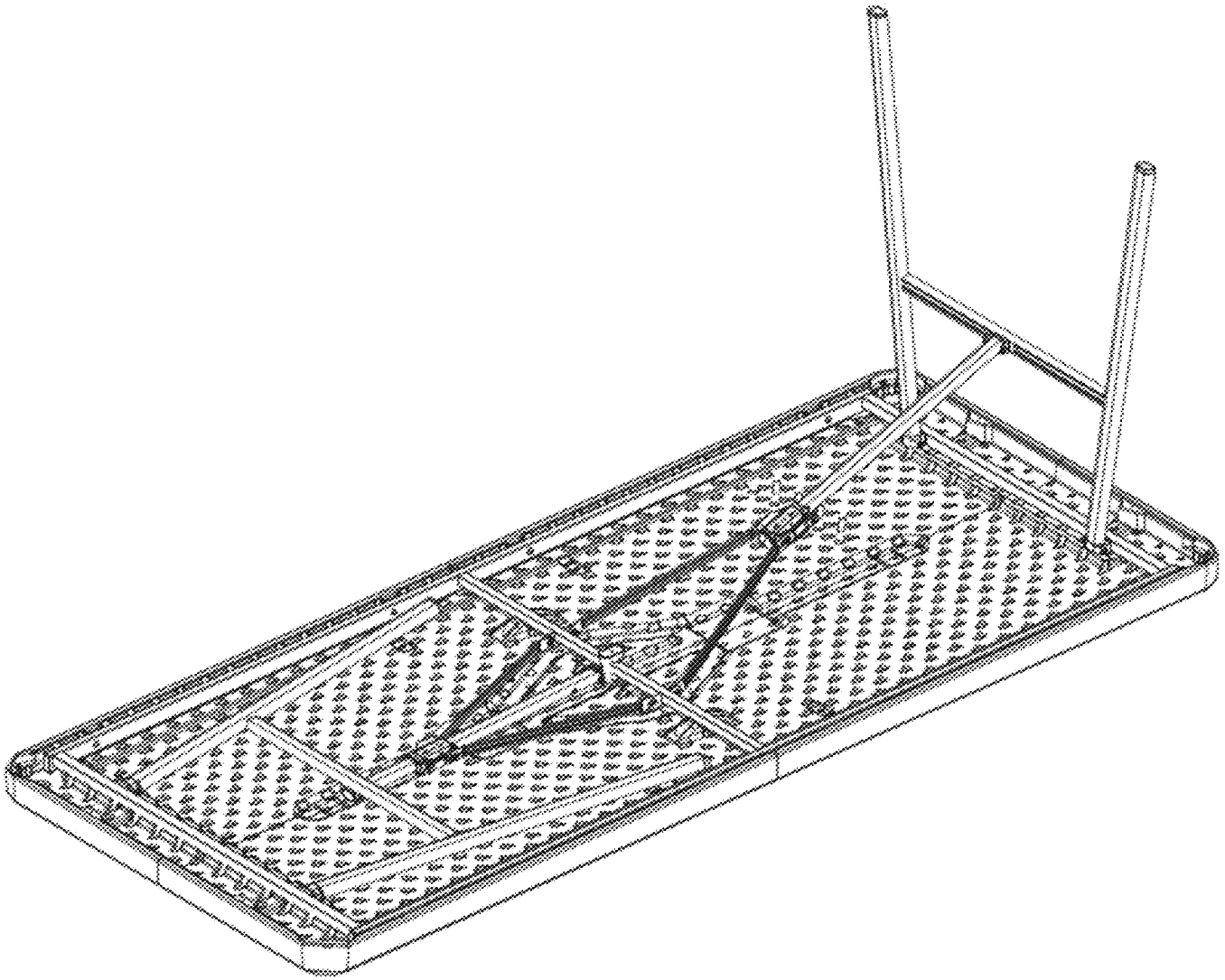
FIG. 6 is a bottom perspective view illustrating the foldable table of FIG. 1 in an intermediate state in accordance with exemplary embodiments of the present disclosure.

Frame 120 also includes two or more leg assemblies coupled with the mounting assembly. For instance, in some embodiments, frame 120 includes first leg assembly 140*a* and second leg assembly 140*b*, each pivotally coupled with the mounting assembly and rotatable with respect to the mounting assembly between a use position and a storage position. As a non-limiting example, FIG. 6 illustrates one leg assembly in the use position and another leg assembly in the storage position. When both of the first and second leg assemblies in the use position, the first and second leg assemblies support the mounting assembly and any other structure (e.g., the table panel) coupled with the mounting assembly. When in the storage position, the first and second leg assemblies are folded toward or onto the mounting assembly, or into an interior defined by the mounting assembly. The first and second leg assemblies can be, but do not have to be, identical or symmetric to each other. In an embodiment, the first and second leg assemblies are substantially the same and substantially symmetrical to each other.

In some exemplary embodiments, one of the first and second leg assemblies is pivotally coupled with the mounting assembly at one side of the mounting assembly and the other of the first and second leg assemblies is pivotally coupled with the mounting assembly at another side of the mounting assembly. For instance, in some embodiments, the first leg assembly is pivotally coupled with first lateral mounting member 133 and the second leg assembly is pivotally coupled with second lateral mounting member 134 of the mounting assembly.

In some exemplary embodiments, each of the first and second leg assemblies includes two or more substantially straight legs. For instance, in some embodiments, first leg assembly 140*a* includes legs 141*a*, 142*a*, and second leg assembly 140*b* includes legs 141*b*, 142*b*. Each of legs 141*a*, 142*a*, 141*b* and 142*b* is substantially straight, e.g., at least 60%, at least 70%, at least 80%, at least 90%, at least 95% or the entire of the leg is substantially straight along a length direction of the leg. Legs 141*a*, 142*a*, 141*b* and 142*b* can be, but do not have to be, identical or symmetric to each other. In an embodiment, legs 141*a*, 142*a*, 141*b* and 142*b* are substantially the same and substantially symmetrical to each other.

Legs 141*a*, 142*a*, 141*b* and 142*b* are slanted outwardly relative to each other. For instance, referring in particular to FIGS. 2 and 3, in some embodiments, leg 141*a* and 142*a* of the first leg assembly are slanted outwardly relative to each other at a first angle α. In some embodiments, leg 141*a* of the first leg assembly and leg 141*b* of the second leg assembly are slanted outwardly relative to each other at a second angle β. Similarly, in some embodiments, leg 141*b* and leg 142*b* of the second assembly are slanted outwardly relative to each other at an angle, which can be, but does not have to be, the same as the first angle. Leg 142*a* of the first leg assembly and leg 142*b* of the second leg assembly are slanted outwardly relative to each other at an angle, which can be, but does not have to be, the same as the second angle.

The degree of the first or second angle should not be too large; otherwise, it would require longer legs and, in some extreme cases, might have an adverse effect on the stability. On the other hand, the degree of the first angle should not be too small; otherwise, it would not, at least not sufficiently, expand the supporting area (e.g., the area defined by the lower ends of legs 141*a*, 142*a*, 141*b* and 142*b*) and enhance the stability of the frame and the structure (e.g., table) having the frame. In addition, the first and second angles can be substantially the same as each other, or different from each other.

In some exemplary embodiments, the first angle is between about 6° and about 26°, between about 8° and about 24°, between about 10° and about 22°, between about 12° and about 20°, or between about 14° and about 18°. In an exemplary embodiment, the first angle is about 16°. In some exemplary embodiments, the second angle is between about 4° and about 20°, between about 6° and about 18°, between about 8° and about 16°, or between about 10° and about 14°. In an exemplary embodiment, the second angle is about 12°.

In some exemplary embodiments, each of legs 141*a*, 142*a*, 141*b* and 142*b* has an upper end portion pivotally coupled with the first or second lateral mounting member of the mounting assembly, for instance, via a coupler such as coupler 136. In an exemplary embodiment, coupler 136 is disposed at an interior side of the mounting assembly, e.g., at a side of the first or second lateral mounting member that faces the third lateral mounting member.

In some exemplary embodiments, each of the first and second leg assemblies includes a lateral leg bar that connects the legs of the first or second leg assembly. For instance, in some embodiments, the first leg assembly includes lateral leg bar 143*a* coupled with leg 141*a* and leg 142*a*, e.g., having an end portion coupled with leg 141*a* and another end portion coupled with leg 142*a*. Lateral leg bar 143*a* has a length greater than a distance between the positions at which the upper end portions of leg 141*a* and leg 142*a* are pivotally coupled with the first mounting member such that leg 141*a* and leg 142*a* of the first leg assembly are slanted outwardly relative to each other at the first angle or the like. Similarly, in some embodiments, the second leg assembly includes lateral leg bar 143*b* coupled with leg 141*b* and coupled with leg 142*b*. Lateral leg bar 143*b* has a length greater than a distance between the positions at which the upper end portions of leg 141*b* and leg 142*b* are pivotally coupled with the second mounting member such that leg 141*b* and leg 142*b* of the first leg assembly are slanted outwardly relative to each other at the first angle or the like.

In some exemplary embodiments, frame 120 further includes one or more supporting assemblies to control rotation of the first and second leg assemblies with respect to the mounting assembly and/or to help stabilize the first and second leg assemblies when they are in the use position. For instance, in some embodiments, frame 120 includes first supporting assembly 150*a* and second supporting assembly 150*b*. The first supporting assembly is coupled with the first leg assembly and mounting assembly, and configured to control rotation of the first leg assembly with respect to the mounting assembly and/or to help stabilize the first leg assembly when it is in the use position. The second supporting assembly is coupled with the second leg assembly and mounting assembly, and configured to control rotation of the second leg assembly with respect to the mounting assembly and/or to help stabilize the second leg assembly when it is in the use position. In some exemplary embodiments, the first and second supporting assemblies also help support the table panel or panels. Examples of supporting assemblies are disclosed in U.S. patent application Ser. No. 16/951,461, the disclosure of the application is incorporated herein for all purposes by reference in its entirety.

The first and second supporting assemblies can be, but do not have to be, identical or symmetric to each other. By way of example, the first and second supporting assemblies are illustrated to be substantially the same and symmetrically to each other. In some exemplary embodiments, each of the first and second supporting assemblies includes a first supporting member such as first supporting member 151, a slider such as slider 153, and one or more second supporting members such as second member 152. As a non-limiting example, two second members are illustrated.

The first supporting member has an end pivotally coupled with the first or second leg assembly, e.g., lateral leg bar 143*a* of the first leg assembly or lateral leg bar 143*b* of the second leg assembly. The slider is coupled with the first supporting member and selectively movable along the first supporting member. Each of the one or more second supporting members has an end pivotally coupled with the slider and another end pivotally coupled with the mounting assembly, e.g., coupled with third lateral mounting member 135 via a coupler such as coupler 137.

When the frame or the table is in use, the slider is locked, automatically or manually, to prevent relative movement of the slider with respect to the first supporting member. In some exemplary embodiments, when locked, the first supporting assembly has a length greater than a distance between the first and third lateral mounting members and the second supporting assembly has a length greater than a distance between the second and third lateral mounting members. As such, when the first and second leg assemblies in the use position, leg 141*a* or 142*a* of the first leg assembly and leg 141*b* or 142*b* of the second leg assembly are slanted outwardly relative to each other at an angle such as the second angle disclosed herein.

In some exemplary embodiments, the frame or the table include additional, optional, or alternative features. For instance, in some embodiments, the table panel includes grooves, channels, depressions, protrusions, or the like to accommodate the frame when folded or to increase the strength of the table panel. As a non-limiting example, in some embodiments, the table panel includes grooves, such as first groove 124*a* and second groove 124*b*, at a lower side of the table panel to accommodate the first and second supporting assemblies when the first and second leg assemblies in the storage position.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise.

It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A frame comprising:

a mounting assembly;

first and second leg assemblies, each pivotally coupled with the mounting assembly and rotatable with respect to the mounting assembly between a use position and a storage position, wherein:

each of the first and second leg assemblies comprises a first leg, a second leg, and a lateral leg bar;

an upper end portion of the first leg of a respective leg assembly in the first and second leg assemblies is pivotally connected to the mounting assembly at a first position;

an upper end portion of the second leg of the respective leg assembly is pivotally connected to the mounting assembly at a second position;

at least a majority portion of each of the first and second legs of the respective leg assembly is substantially straight;

the lateral leg bar of the respective leg assembly connects the first and second legs of the respective leg assembly and has a length between the first and second legs of the respective leg assembly that is greater than a distance between the first position and the second position such that the first and second legs of the respective leg assembly are slanted outwardly relative to each other at a first angle;

in the use position, the first legs of the first and second leg assemblies or the second legs of the first and second leg assemblies are slanted outwardly relative to each other at a second angle; and in the storage position, the first and second assemblies are folded toward the mounting assembly; and first and second supporting assemblies to control rotation of the first and second leg assemblies with respect to the mounting assembly or help stabilize the first and second leg assemblies when they are in the use position, wherein each of the first and second supporting assemblies comprises:

a first supporting member having an end pivotally coupled with the first or second leg assembly;

a slider coupled with the first supporting member and selectively movable along the first supporting member; and one or more second supporting members, each having an end pivotally coupled with the slider and another end pivotally coupled with the mounting assembly.

2. The frame of claim 1, wherein the first angle is between about 6° and about 26°.

3. The frame of claim 1, wherein the second angle is between about 4° and about 20°.

4. The frame of claim 1, wherein the first angle is different than the second angle.

5. The frame of claim 1, wherein the first and second legs of the first or second leg assembly are symmetric with respect to each other.

6. The frame of claim 1, wherein the first and second leg assemblies are symmetric with respect to each other.

7. A table comprising:

a table panel; and the frame of claim 1 coupled with the table panel to support the table panel when in use.

8. The table of claim 7, wherein the first angle is between about 6° and about 26°, and the second angle is between about 4° and about 20°.

9. The table of claim 7, wherein the table panel comprises a first groove and a second groove at a lower side of the table panel to accommodate the first and second supporting assemblies when the first and second leg assemblies in the storage position.

10. A frame comprising:

a mounting assembly comprising:

a first longitudinal mounting member and a second longitudinal mounting member spaced apart from each other;

a first lateral mounting member and a second lateral mounting member spaced apart from each other and coupled with the first and second longitudinal mounting members; and a plurality of couplers disposed at the first and second lateral mounting members; and first and second leg assemblies, each comprising a first leg and a second leg pivotally coupled with the mounting assembly by the plurality of couplers disposed at the first or second mounting member, and rotatable with respect to the mounting assembly between a use position and a storage position, wherein:

at least a majority portion of each of the first and second legs is substantially straight;

the first and second legs of the first or second leg assembly are slanted outwardly relative to each other at a first angle;

in the use position, the first legs of the first and second leg assemblies or the second legs of the first and second leg assemblies are slanted outwardly relative to each other at a second angle; and in the storage position, the first and second assemblies are folded toward the mounting assembly.

11. The frame of claim 10, wherein each of the first and second leg assemblies further comprises a lateral leg bar connecting the first and second legs of the first or second leg assembly.

12. The frame of claim 10, wherein the plurality of couplers is disposed at an interior side of the mounting assembly.

13. The frame of claim 10, wherein the mounting assembly further comprising a third lateral mounting disposed between the first and second mounting members, the frame further comprising:

first and second supporting assemblies, wherein the first supporting assembly is pivotally coupled with the third lateral mounting member of the mounting assembly and first leg assembly;

the second supporting assembly is pivotally coupled with the third lateral mounting member of the mounting assembly and second leg assembly; and the first supporting assembly has a length greater than a distance between the first and third lateral mounting members and the second supporting assembly has a length greater than a distance between the second and third lateral mounting members such that when in the use position, the first legs of the first and second leg assemblies or the second legs of the first and second leg assemblies are slanted outwardly relative to each other at a second angle.

14. The frame of claim 13, wherein the first angle is between about 6° and about 26°, and the second angle is between about 4° and about 20°.

15. The frame of claim 14, wherein the first angle is about 16° and the second angle is about 12°.

16. The frame of claim 13, wherein each of the first and second supporting assemblies comprises:

a first supporting member having an end pivotally coupled with the first or second leg assembly;

a slider coupled with the first supporting member and selectively movable along the first supporting member; and one or more second supporting members, each having an end pivotally coupled with the slider and another end pivotally coupled with the mounting assembly.

17. A table comprising:

a table panel; and the frame of claim 10 coupled with the table panel to support the table panel when in use.

* * * * *